US005992804A

United States Patent [19]

Johnson

[11] Patent Number: 5,992,804

[45] Date of Patent: Nov. 30, 1999

[54] SEAT PEDESTAL ASSEMBLY

[76] Inventor: William A. Johnson, 12406 Taylorsville Rd., Louisville, Ky. 40299

[21] Appl. No.: 08/916,591

[22] Filed: Aug. 22, 1997

[51] Int. Cl.[6] ..... F16M 11/00; B63B 17/00; A47C 15/00

[52] U.S. Cl. ..... 248/157; 248/188.9; 248/230.2; 248/538; 297/248; 297/188.01; 114/363; 114/364; 403/305; 403/310

[58] Field of Search ..... 248/157, 520, 248/512, 513, 518, 519, 538, 539, 540, 541, 126, 230.2, 315, 158, 188.9; 297/188.01, 188.2, 184.1, 184.16, 232, 240, 248, 249; 114/363, 364; 403/305, 310, 313, 300

[56] References Cited

U.S. PATENT DOCUMENTS

| | | | |
|---|---|---|---|
| 550,588 | 12/1895 | Burr | 297/248 X |
| 677,195 | 6/1901 | Frederick | 297/240 |
| 1,266,770 | 5/1918 | Burton | 248/540 |
| 1,653,083 | 12/1927 | Blaw | 248/538 |
| 2,607,398 | 8/1952 | Andrews | 297/188.01 |
| 2,877,827 | 3/1959 | Anderson . | |
| 3,323,833 | 6/1967 | Kasparian | 297/248 |
| 3,784,250 | 1/1974 | Beeman . | |
| 4,441,837 | 4/1984 | Mastroni | 403/305 X |
| 4,587,921 | 5/1986 | Currey . | |
| 4,597,356 | 7/1986 | McCaghren et al. . | |
| 4,645,167 | 2/1987 | Hardwick . | |
| 4,790,500 | 12/1988 | Mori | 248/157 X |
| 4,802,752 | 2/1989 | Anglin | 403/305 X |
| 5,394,822 | 3/1995 | Worland . | |
| 5,551,660 | 9/1996 | Leduchowski | 248/541 X |
| 5,639,059 | 6/1997 | Nash . | |

*Primary Examiner*—Ramon O. Ramirez
*Assistant Examiner*—Stephen S. Wentsler
*Attorney, Agent, or Firm*—James C. Eaves, Jr.; Daniel C. Stelter; Greenebaum Doll & McDonald PLLC

[57] ABSTRACT

A seat pedestal assembly including a center post having a lower distal end adapted to be slidingly and rotatably received by a boat deck; a support frame including a center sleeve and a plurality of seat members disposed parallel to and in spaced relation with the center sleeve, the seat members being angularly spaced equidistantly around the center post, each of the seat members having an inner diameter, an outer diameter and a length, each of the seat members being respectively connected to the center sleeve by a connecting member; the center sleeve having an inner diameter adapted to slidingly and rotatably receive the center post therethrough; and, each of the seat members inner diameter being adapted to respectively receive for axial and rotational movement therein a seat post provided depending downwardly from an existing seat.

4 Claims, 9 Drawing Sheets

SEAT PEDESTAL ASSEMBLY

BACKGROUND OF THE INVENTION

1. Technical Field of the Invention

The present invention relates to seat pedestal assemblies for use on boat decks. More particularly, the present invention relates to a seat pedestal assembly for use on a boat deck, wherein the pedestal assembly supports a plurality of seats.

2. Discussion of the Prior Art

A seat is often provided on a deck of a boat to permit any passenger thereof to sit thereon or fish therefrom. More particularly, the seat is typically located towards the front portion of the boat deck and is pivotable about an axis thereof perpendicular to the boat deck, thereby permitting the passenger thereof to sit thereon and face outwardly from the boat in any direction therefrom.

It is often desirable to provide a second seat towards the rear portion of the boat deck which permits a second passenger to sit thereon or fish therefrom while permitting a first passenger to simultaneously sit on or fish from the first seat. However, with respect to many boats typical of the prior art, the rear portion of the boat deck often neither includes a second boat seat nor permits the provision of a second seat due to the presence of other permanent fixtures, such as, for example, an operator's cabin, a passenger bench or a water skiing post. In such a boat, only one passenger may sit on or fish from the first seat; the remaining passengers must therefore either stand on the boat deck or fish from non-pivotable bench seats, which is often uncomfortable or undesirable. It is therefore desirable to provide a seat pedestal assembly for use on a boat deck, wherein the pedestal assembly supports a plurality of seats.

It is furthermore desirable to provide a seat pedestal assembly for use on a boat deck, wherein the pedestal assembly is pivotally mounted to the boat deck using existing seat mounting means provided by the boat deck.

It is even furthermore desirable to provide a seat pedestal assembly for use on a boat deck, wherein the pedestal assembly includes means for receiving various attachments thereto, such as, for example, an overhead umbrella or a handle of a fishing rod.

It is furthermore desirable to provide a seat pedestal assembly for use on a boat deck wherein the pedestal assembly provides individual pivotal movement to the plurality of seats attached thereto.

SUMMARY OF THE INVENTION

It is an object of the present invention to provide a seat pedestal assembly for use on a boat deck, wherein the pedestal assembly supports a plurality of seats.

It is another object of the present invention to provide a seat pedestal assembly for use on a boat deck, wherein the pedestal assembly is pivotally mounted to the boat deck using existing seat mounting means provided by the boat deck.

It is still another object of the present invention to provide a seat pedestal assembly for use on a boat deck, wherein the pedestal assembly includes means for receiving various attachments thereto.

It is yet another object of the present invention to provide a seat pedestal assembly for use on a boat deck wherein the pedestal assembly provides individual pivotal movement to the plurality of seats attached thereto.

A seat pedestal assembly for use on a boat deck according to the present invention includes a center post having a lower distal end adapted to be slidingly and rotatably received by a boat deck; a support frame including a center sleeve and a plurality of seat members disposed parallel to and in spaced relation with the center sleeve, the seat members being angularly spaced equidistantly around the center post, each of the seat members having an inner diameter, an outer diameter and a length, each of the seat members being respectively connected to the center sleeve by a connecting member; the center sleeve having an inner diameter adapted to slidingly and rotatably receive the center post therethrough; and, each of the seat members inner diameter being adapted to respectively receive for axial and rotational movement therein a seat post provided depending downwardly from an existing boat seat.

BRIEF DESCRIPTION OF THE DRAWINGS

A better understanding of the present invention will be had upon reference to the following description in conjunction with the accompanying drawings in which like numerals refer to like parts, and wherein.

DETAILED DESCRIPTION OF THE PREFERRED EMBODIMENT

Figure 1:
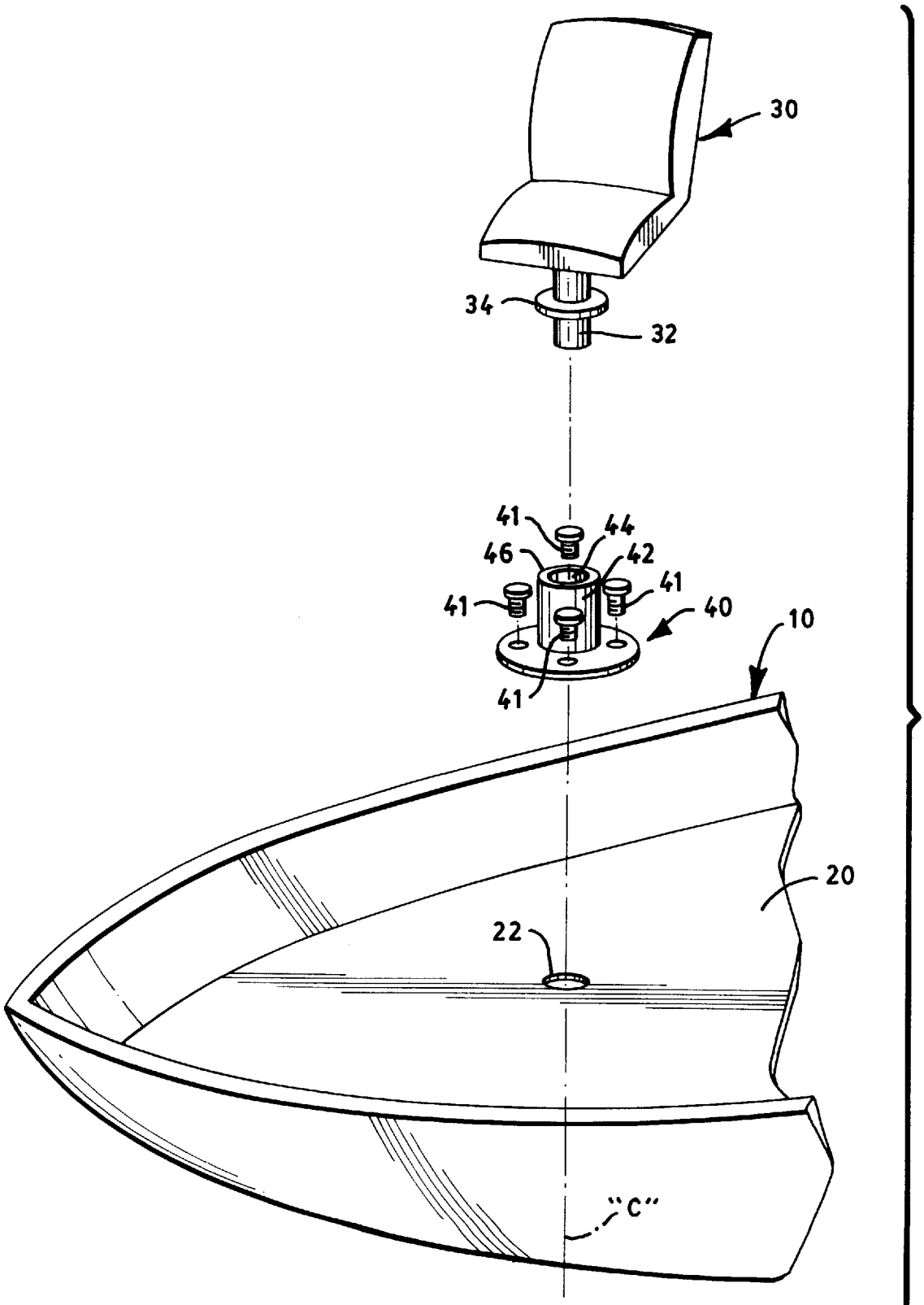
FIG. 1 (PRIOR ART)
FIG. 1 is an exploded perspective view of a portion of a boat typical of those of the prior art.
Figure 2:
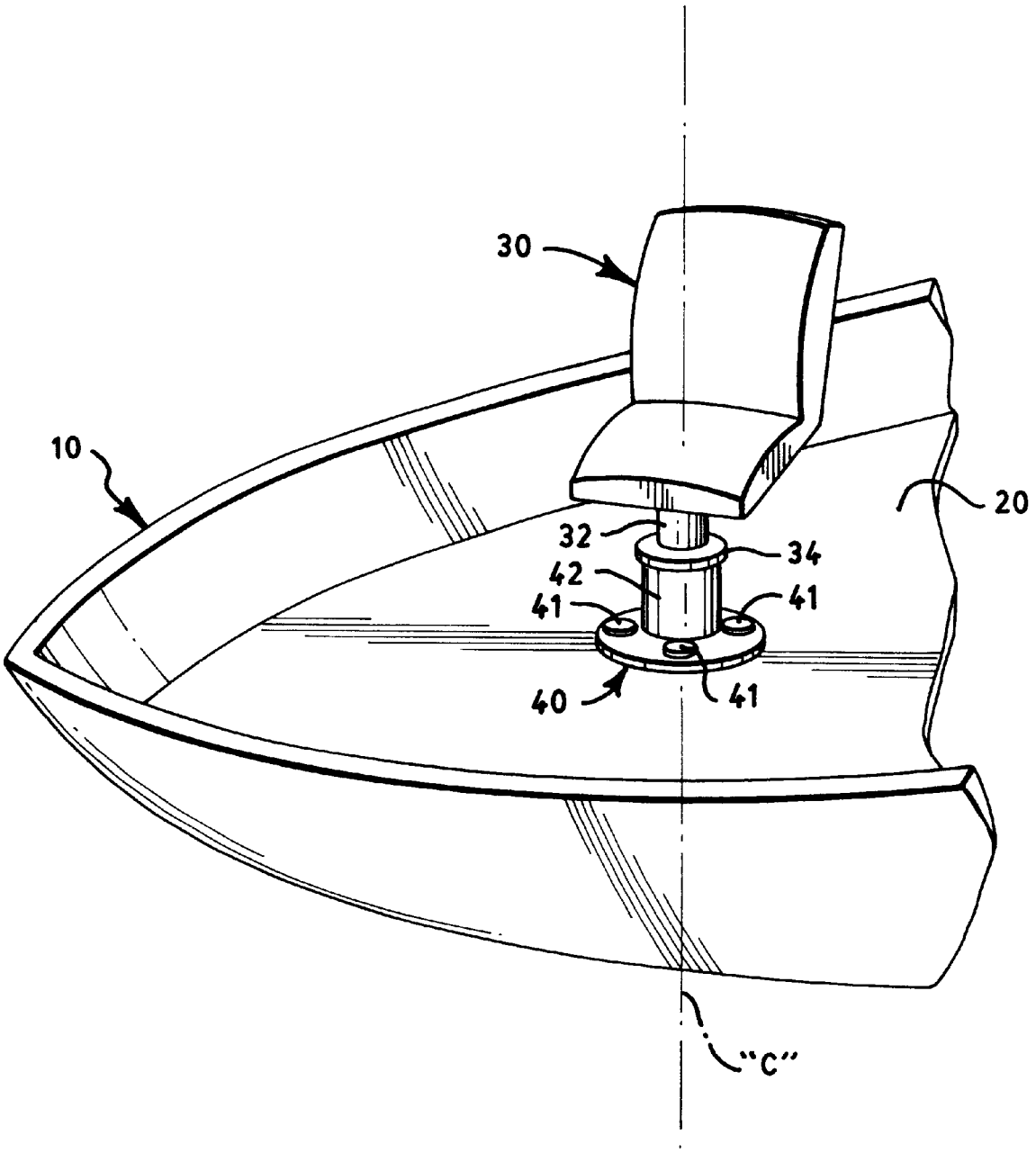
FIG. 2 (PRIOR ART)
FIG. 2 is an assembled perspective view of the portion of the boat of FIG. 1.

With reference to FIGS. 1 and 2, a boat 10, typical of those in the prior art, includes a deck 20 having an opening 22 therein to which a seat 30 is pivotally mounted about an axis "C" normal to a plane substantially containing the deck 20. A flange 40 is fixedly attached, such as, for example, by bolting with a plurality of bolts 41, to the deck 20 and includes a sleeve portion 42 coaxially aligned with the axis "C" and having a cylindrical bore 44 provided therethrough. The seat 30 includes a post 32 projecting downwardly therefrom and is slidingly and rotatably receivable by the cylindrical bore 44 of the flange sleeve portion 42 coaxially therewith. The post 32 includes an axial stop 34 fixedly attached thereto, such as, for example, by welding, and having an underside surface thereof (not shown) which abuts an upper annular edge 46 of the sleeve portion 40 and prevents downward axial movement of the seat 30 relative to and within the cylindrical bore 44 beyond a predetermined length.

Figure 3:
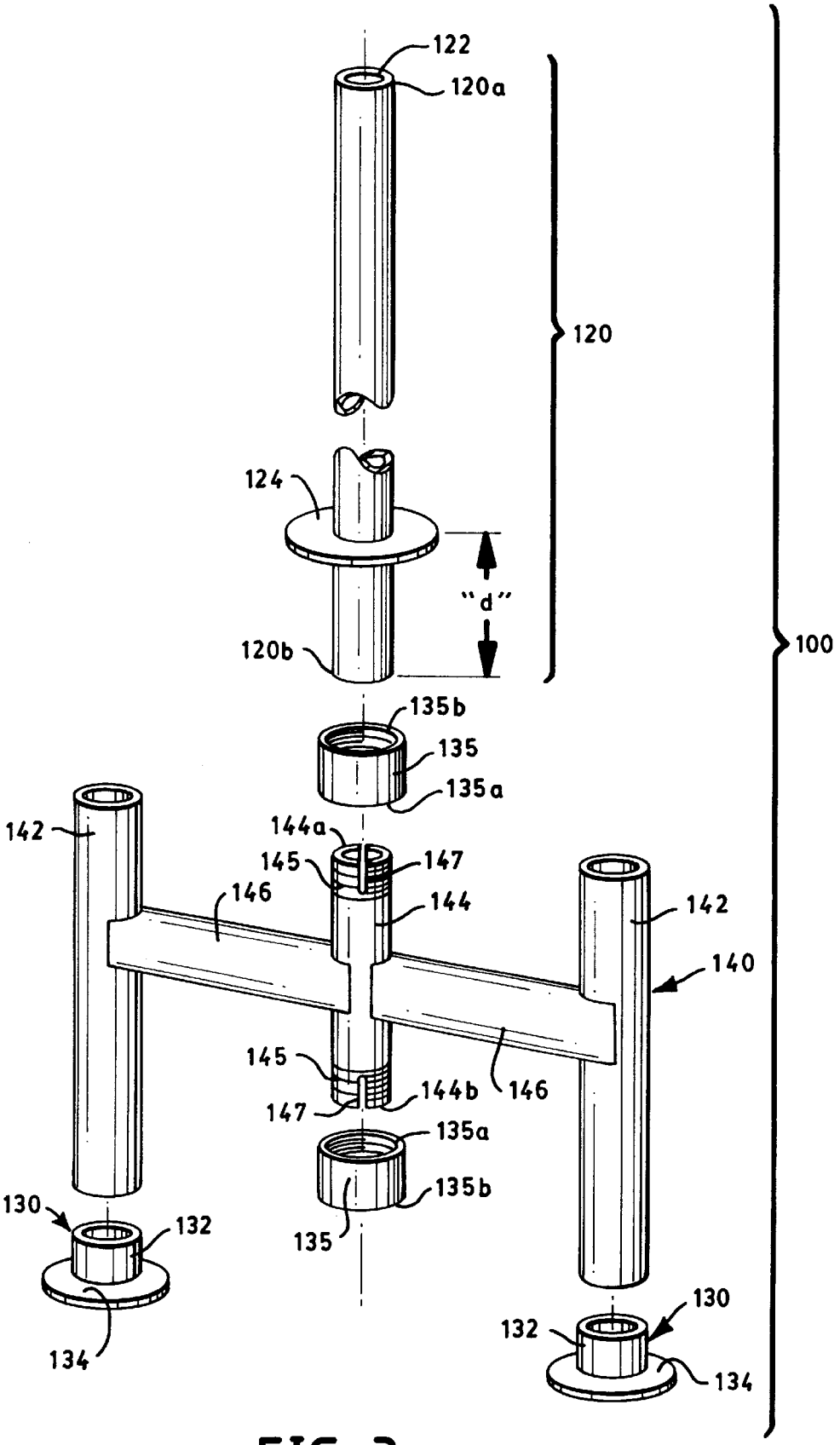
FIG. 3 is an exploded perspective view of the seat pedestal assembly of the present invention.

With reference to FIG. 3, a seat pedestal assembly 100 according to the preferred embodiment of the present invention includes a center post 120, a support frame 140, a pair of locking collars 135 and a pair of feet 130. The center post 120 includes upper and lower distal ends 120*a* and 120*b*, respectively, and an outer circumference sized to be slidingly and rotatably received by the cylindrical bore 44 of the flange sleeve portion 42 and the boat deck opening 22 (FIG. 1). A stop 124 is attached to the center post 120 towards the lower distal end 120*b* thereof a distance "d" therefrom. The post 120 also includes a cylindrical bore 122 therethrough having an inner diameter sized to slidingly and rotatably receive a post 160 (FIG. 9), for example, from an umbrella (not shown). The center post 120 is preferably constructed from metal tubing, such as, for example, aluminum tubing, and may be treated to resist corrosion.

The support frame 140 is preferably a welded construction of metal tubing elements, such as, for example, aluminum tubing, and may be treated to resist corrosion. The support frame 140 includes a pair of vertical seat receiving members 142 disposed along respective parallel central axes thereof and in spaced relation to one another, a vertical center sleeve 144 disposed along a central axis thereof parallel to the central axes of the seat receiving members 142 and preferably spaced equidistantly therebetween, and a pair of coaxial horizontal connecting members 146 disposed along a central axis perpendicular to the central axis of the center sleeve 144. The connecting members 146 respectively fixedly connect each seat receiving member 142 to the center sleeve 144.

Figure 4:
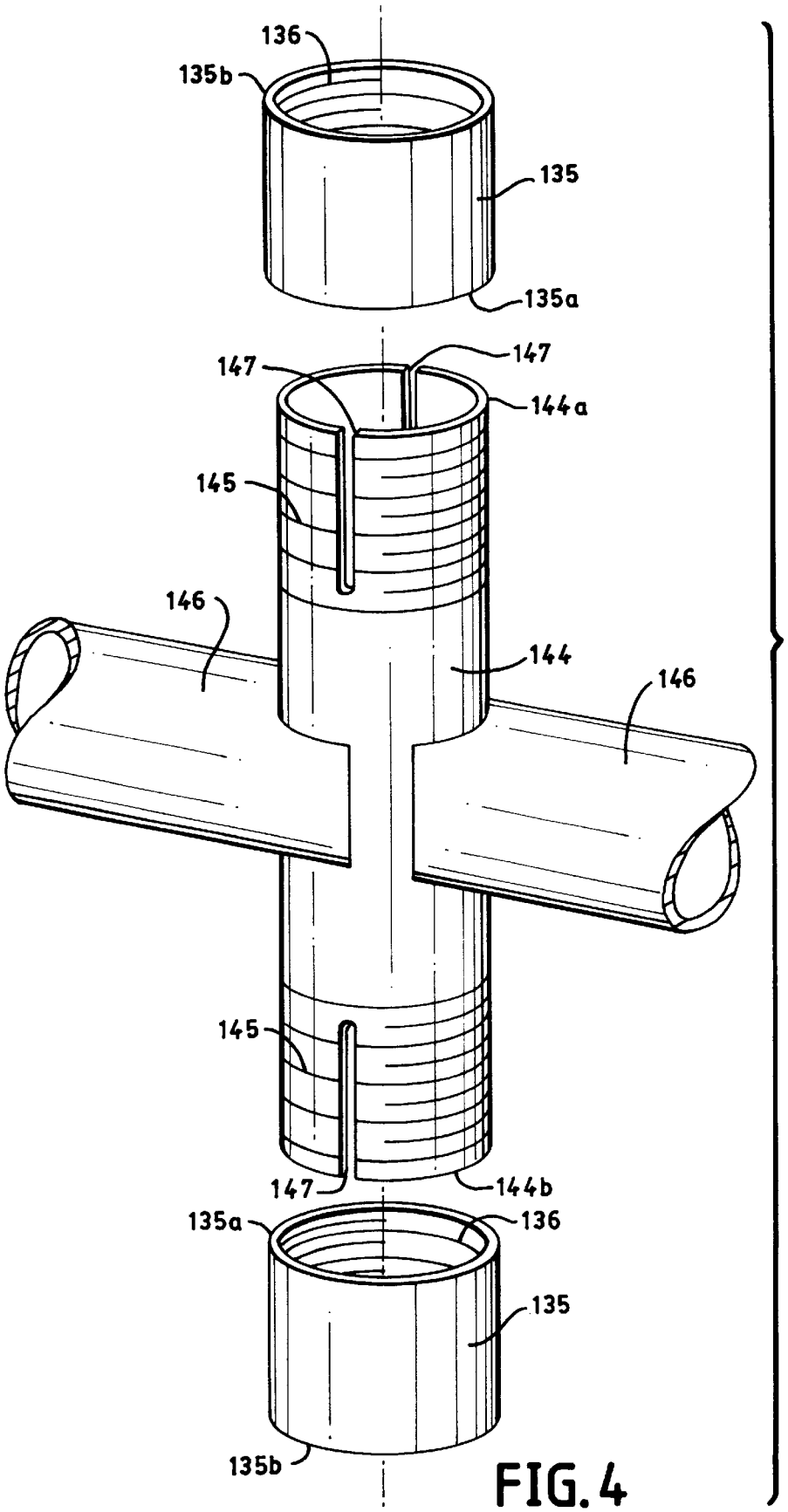
FIG. 4 is a detail perspective view of one element of the seat pedestal assembly of FIG. 3.
Figure 5:
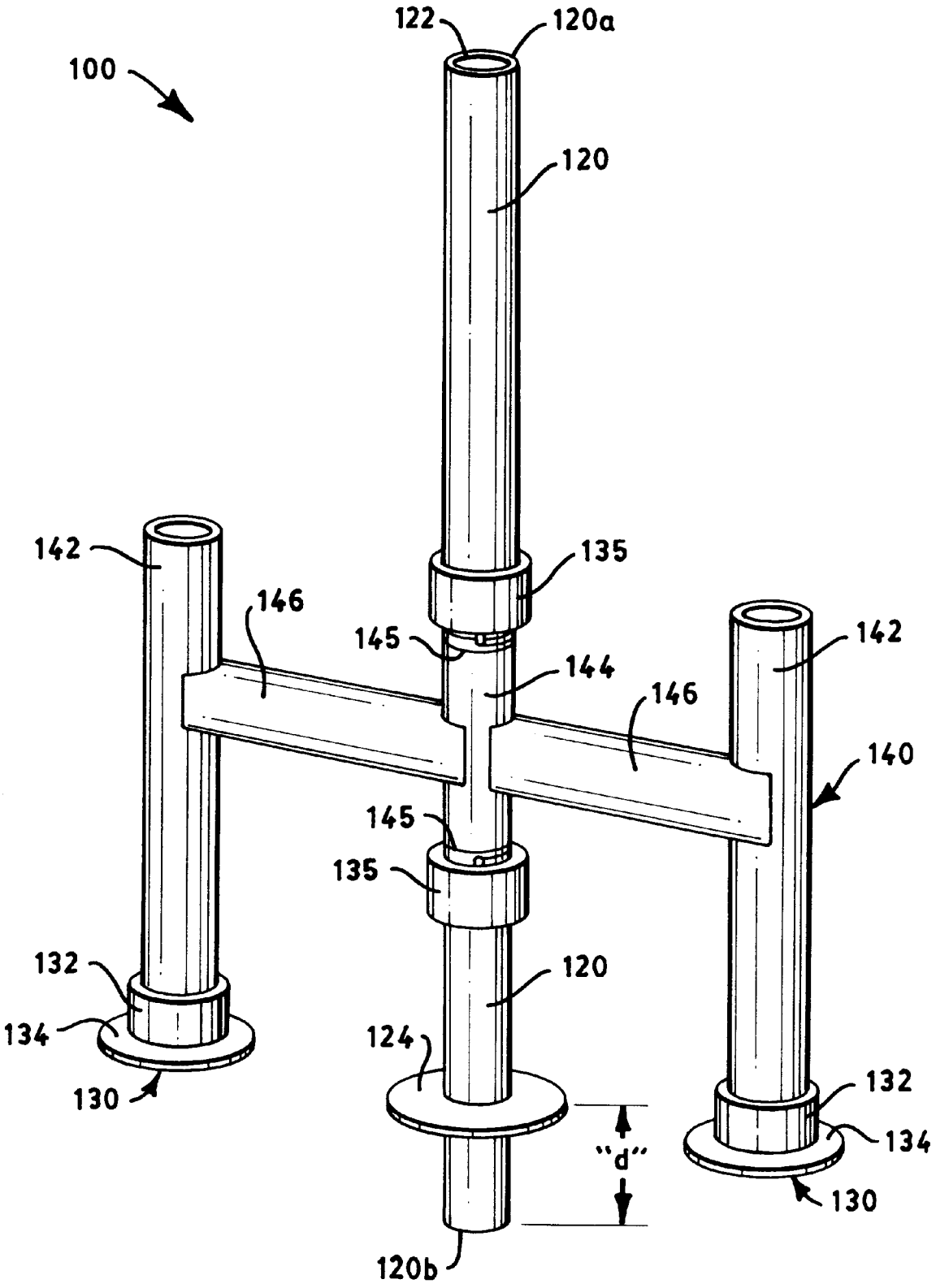
FIG. 5 is an assembled perspective view of the seat pedestal assembly of FIG. 3.
Figure 8:
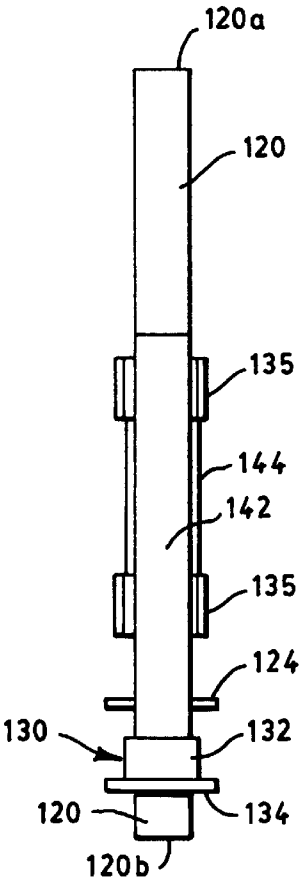
FIG. 8 is a right side view of the seat pedestal assembly of FIG. 3.
Figure 7:
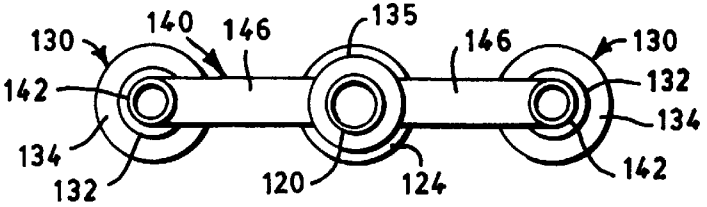
FIG. 7 is a top view of the seat pedestal assembly of FIG. 3.
Figure 6:
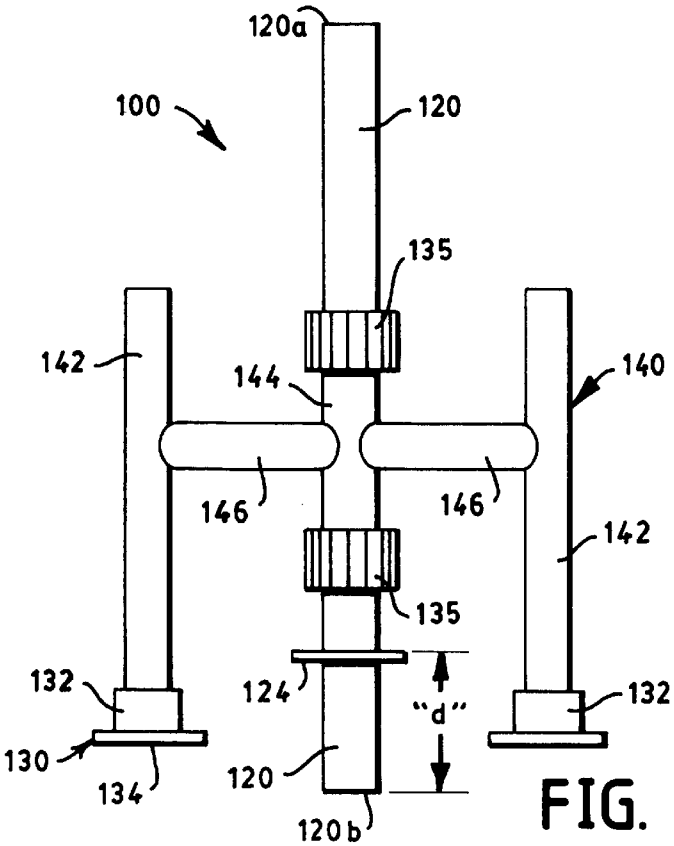
FIG. 6 is a front view of the seat pedestal assembly of FIG. 3.

With additional reference to FIG. 4, the center sleeve 144 includes upper and lower distal ends 144*a* and 144*b*, respectively, thereof, each distal end 144*a* and 144*b* having an external thread 145 provided on an outer surface of the center sleeve 144 and having a pair of diametrically-opposed axial slits 147 provided through the center sleeve 144 for a predetermined distance. The locking collars 135 are provided with an internal thread 136 on an inner surface thereof sized to respectively engage the external thread 145 of the center sleeve 144. The locking collars 135 are provided with an inner bore having a decreasing diameter therethrough. The locking collar inner bore diameter is largest at a distal end 135*a* thereof sized to receive the respective distal end 144*a* and 144*b* of the center sleeve 144 and is smallest at a distal end 135*b* thereof opposite the distal end 135*a* having the largest diameter. As the locking collars 135 are threadingly engaged with their respective center sleeve distal ends 144*a* and 144*b*, the distal ends of the center sleeve 144 move radially inwardly as the collars 135 are threaded further thereon, as permitted by the slits 147, thereby imposing an inwardly-directed clamping force on any object disposed therein, such as, for example, the center post 120.

With reference back to FIG. 3, the seat receiving members 142 respectively include upper and lower distal ends thereof, the respective lower distal ends being sized to be received by the feet 130. Preferably, the feet 130 are constructed from a commercially-available flange having a sleeve portion 132 and a disc 134 fixedly attached to a lower edge of the sleeve portion 132 coaxially therewith. The disc 134 may include a non-slip underside surface (not shown) for frictionally engaging the boat deck 20.

With additional reference to FIGS. 5–8, the seat pedestal assembly 100 is assembled by aligning the feet 130 with the seat receiving members 142 coaxially therewith towards the respective lower distal ends thereof. The respective lower distal ends of the seat receiving members 142 are axially received by the sleeve portion 132 of the feet 130 and may be fixedly attached thereto by means, such as, for example, a set screw or a bolt. The center post 120 is aligned with the center sleeve 144 and axially received therethrough until the lower distal end 120*b* of the center post 120 is vertically below the lower distal ends of the seat receiving members 142. The collars 135 are slidingly received by the upper and lower distal ends, 120*a* and 120*b*, respectively, and threadingly engaged with the respective external threading 145 of the center sleeve 144. The decreasing diameter of the locking collars 135 causes the upper and lower distal ends of the center sleeve 144 to clamp the center post 120 firmly therein, preventing further axial movement of the center post 120 within the center sleeve 144.

Figure 9:
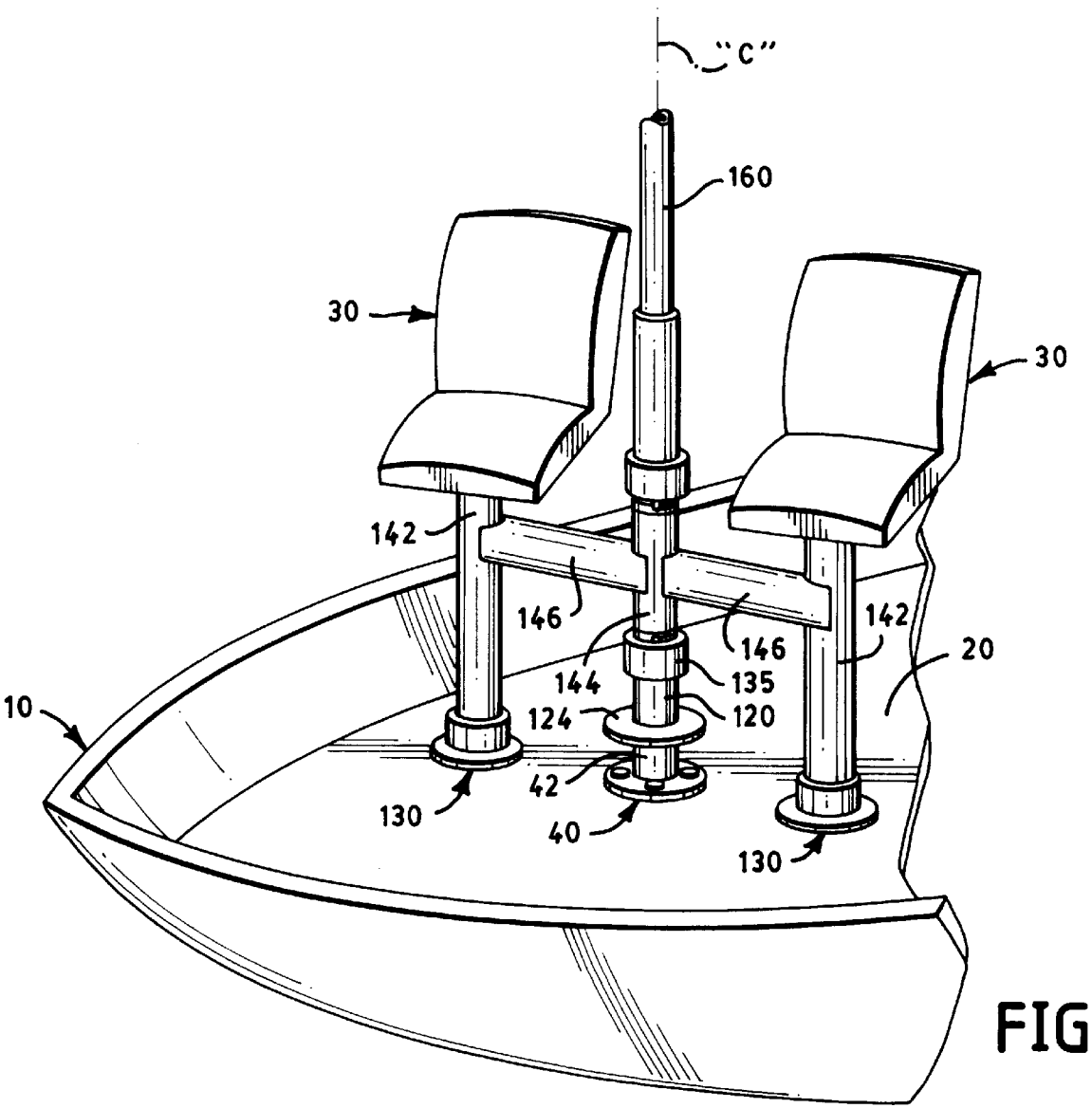
FIG. 9 is a top perspective view of the seat pedestal assembly of FIG. 3 shown mounted to the boat deck of FIG. 1.
Figure 10:
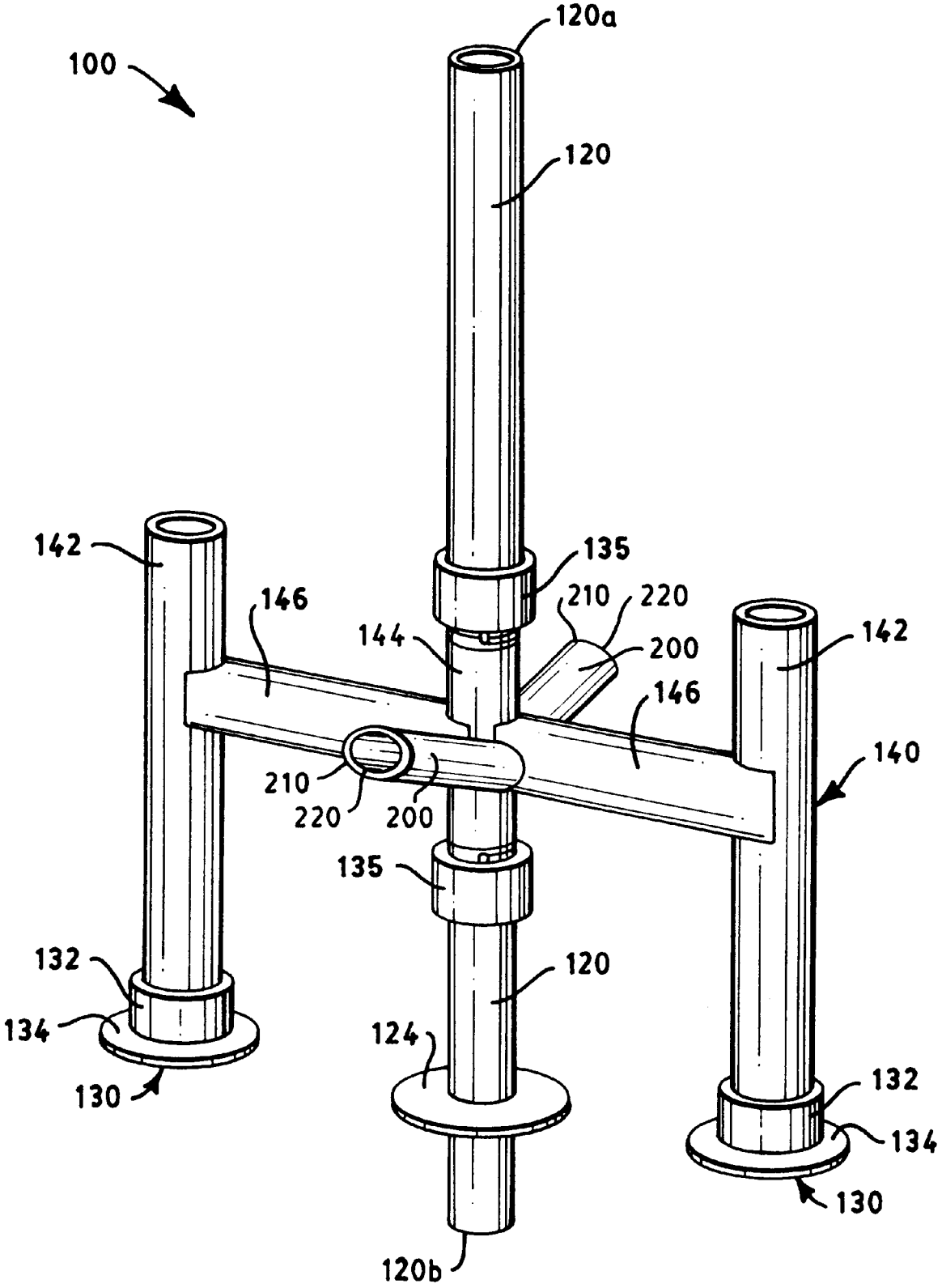
FIG. 10 is a top perspective view of the seat pedestal assembly according to another embodiment of the present invention.
Figure 13:
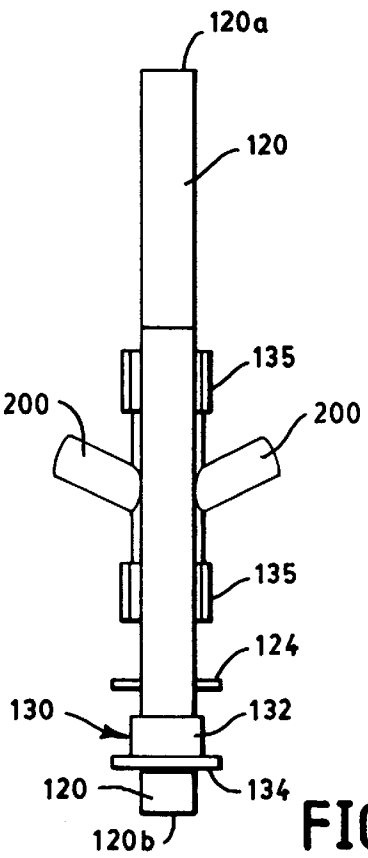
FIG. 13 is a right side view of the seat pedestal assembly of FIG. 10.
Figure 12:
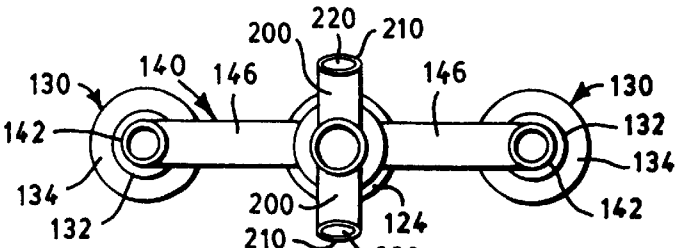
FIG. 12 is a top view of the seat pedestal assembly of FIG. 10.
Figure 11:
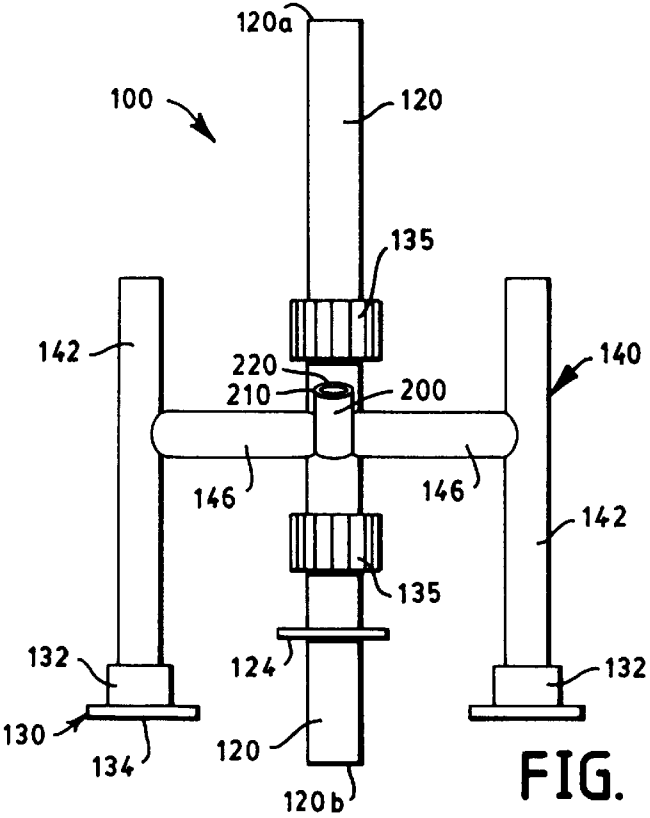
FIG. 11 is a front view of the seat pedestal assembly of FIG. 10.

With reference to FIG. 9, the lower distal end 120*b* of the center post 120 is slidingly received by the sleeve portion 42 of the boat deck flange 40 and by the deck opening 22 (not shown) disposed therebelow coaxially therewith until the underside surfaces of the feet discs 134 abut the boat deck 20 and prevent further downward axial movement thereof. The axial position of the center post 120 relative to the center sleeve 144 is adjusted by loosening and tightening the locking collars 135 accordingly and sliding the center post 120 through the center sleeve 144 until an underside surface (not shown) of the stop 124 abuts the upper annular edge 46 (FIG. 1) of the flange sleeve portion 42. Distance "d" is sufficiently large to permit sufficient insertion of the lower distal end 120*b* of the center post 120 into the flange sleeve portion 42 to resist pivotal movement of the center post 120 about the plane substantially containing the boat deck 20. The seat pedestal assembly 100 is therefore supported from axial movement by the feet 130 and from pivotal movement relative to the plane substantially containing the boat deck 120 by the center post 120 being received within the sleeve portion 42 of the boat deck flange 40.

The seat pedestal assembly 100 may be rotated about the axis "C" by moving the seat pedestal assembly 100 axially upwardly so that the center post 120 moves axially upwardly within the sleeve portion 42 of the boat deck flange 40 slightly until the respective underside surfaces of the feet discs 134 no longer contact the boat deck 20, freely rotating the seat pedestal assembly 100 about axis "C" to a desired rotational position, and moving the seat pedestal assembly 100 axially downwardly so that the center post 120 moves axially downwardly within the sleeve portion 42 of the boat deck flange 40 slightly until the respective underside surfaces of the feet discs 134 regain contact with the boat deck 20.

Alternatively, the seat pedestal assembly 100 may be rotated about the axis "C" by loosening the locking collars 135, thereby removing the clamping force imposed on the center post 120 therefrom, moving the support frame 140 axially upwardly relative to the center post 120, rotating the support frame 140 to a desired angular position, moving the support frame axially downwardly until the respective underside surfaces of the feet 130 contact the boat deck 20, and tightening the locking collars 135 to clamp the center post 120 therein.

A pair of existing seats 30 having seat posts 32 (FIG. 1) are received by the respective upper distal ends of the seat receiving members 142 and are slidingly and rotatably moveable about their respective central axes relative thereto.

The upper distal ends of the seat receiving members 142 may be provided with clamping slits (not shown) and threading (not shown) such as is provided on the distal ends of the center sleeve 142, or any functional equivalent thereof, to provide clamping means for preventing movement of the seats 30 relative to the seat receiving members 142. The upper distal end 120*a* of the center post 120 is sized to receive the post 160 of an overhead umbrella (not shown) to provide shelter for passengers seated in the seats 30. The upper distal end 120*a* may also be provided with clamping slits (not shown) and threading (not shown) such as is provided on the distal ends of the center sleeve 142, or any functional equivalent thereof, to provide clamping means for preventing movement of the umbrella post 160 relative to the center post 120. The lower distal end 120*b* of the center post 120 may also be sealed or closed to prevent the umbrella post 160 from sliding through the enter post 120 and exiting therefrom at the lower distal end 120*b* thereof.

With reference to FIGS. 10–13, an alternative embodiment of the present invention includes many of the elements hereinabove described with respect to the preferred embodiment of the present invention, and like numerals are intended to represent like elements. However, the present embodiment further includes a pair of diametrically-opposed attachments 200 projecting upwardly and outwardly from the center sleeve 144 towards the connecting members 146. The attachments 200 are constructed from tubular metal, such as, for example, tubular aluminum, and are attached to the center sleeve 144 by any suitable means, such as, for example, by welding. The attachments 200 include outward distal ends 210 having openings 220 therethrough sized to receive the handle portion of a fishing rod (not shown). The attachments project upwardly from the center sleeve 144 at an angle relative thereto, such as, for example, 60 degrees, although any angle relative thereto may be used in place thereof without departing from either the spirit or the scope of the present invention.

In another alternative embodiment of the present invention, any suitable means for providing radial clamping may be substituted in place of the axial slits 147, the threading 145 and the locking collars 135 without departing from either the spirit or the scope of the present invention.

In yet another alternative embodiment of the present invention, the pair of seat receiving members 142 and their respective connecting members 146 may be replaced with a plurality of seat receiving members 142 and connecting members 146, such as, for example, three or more seat receiving members 142, each seat receiving member 142 being connected to the center sleeve 144 by a connecting member 146, the plurality of seat receiving members 142 being angularly spaced equidistantly around the center sleeve 144.

The foregoing detailed description is given primarily for clearness and understanding and no unnecessary limitations are to be understood therefrom as modifications will become obvious to those skilled in the art upon reading this disclosure and may be made without departing from the spirit of the present invention.

I claim:

1. A seat pedestal assembly for use with a seat post receiver, comprising:

a center post having a lower distal end adapted to be received by said seat post receiver;

a support frame including a center sleeve and a plurality of seat receiving members disposed parallel to and in spaced relation with said center sleeve, said seat members being angularly spaced around said center post, each said seat receiving member having an inner diameter, an outer diameter and a length, each said seat receiving member being respectively connected to said center sleeve by a connecting member; said center sleeve having an inner diameter adapted to slidingly and rotatably receive said center post therethrough;

each said seat receiving member inner diameter being adapted to respectively receive therein a seat post; and, means for locking said center post in fixed relation to said center sleeve wherein said center post locking means comprises:

a pair of axial slits provided through said center sleeve towards an upper distal end thereof;

a pair of axial slits provided through said center sleeve towards a lower distal end thereof;

an upper external thread provided on an outer surface of said center sleeve towards said upper distal end thereof;

a lower external thread provided on said outer surface of said center sleeve towards said lower distal end thereof;

an upper locking collar having first and second distal ends thereof and an internally-threaded bore provided therethrough between said first and said second distal ends, said internal thread being adapted to receive said upper external thread of said center sleeve, said bore having a first diameter towards said first distal end thereof adapted to receive said upper distal end of said center sleeve, said bore having a second diameter towards said second distal end thereof, said second diameter being less than said first diameter; and, a lower locking collar having first and second distal ends thereof and an internally-threaded bore provided therethrough between said first and said second distal ends, said internal thread being adapted to receive said lower external thread of said center sleeve, said bore having a first diameter towards said first distal end thereof adapted to receive said lower distal end of said center sleeve, said bore having a second diameter towards said second distal end thereof, said second diameter being less than said first diameter.

2. A seat pedestal assembly for use with a seat post receiver, comprising:

a center post having a lower distal end adapted to be received by said seat post receiver;

a support frame including a center sleeve and a plurality of seat receiving members disposed parallel to and in spaced relation with said center sleeve, said seat members being angularly spaced around said center post, each said seat receiving member having an inner diameter, an outer diameter and a length, each said seat receiving member being respectively connected to said center sleeve by a connecting member; said center sleeve having an inner diameter adapted to slidingly and rotatable receive said center post therethrough;

each said seat receiving member inner diameter being adapted to respectively receive therein a seat post; and, a plurality of feet, each of said plurality of feet having a sleeve portion adapted to respectively receive a lower distal end of each of said plurality of seat receiving members.

3. The seat pedestal assembly according to claim 2, wherein:

said center post includes an upper distal end having an opening therethrough.

4. The seat pedestal assembly according to claim 2, further comprising:

a plurality of attachments connected to said center sleeve equidistantly between said plurality of seat members, each of said plurality of attachments projecting upwardly and outwardly from said center sleeve, each of said plurality of attachments including an outwardly distal end thereof having an opening therethrough.

* * * * *